US005419693A

United States Patent [19]

MacMillan

[11] Patent Number: 5,419,693

[45] Date of Patent: May 30, 1995

[54] ANGLE HEAD

[76] Inventor: Donald M. MacMillan, 3296 Rockhill Avenue, Clearbrook, BC, Canada, V2S 5J7

[21] Appl. No.: 243,710

[22] Filed: May 17, 1994

[51] Int. Cl.[6] ..... B05C 17/10; B05C 17/12

[52] U.S. Cl. ..... 425/87; 15/235.7; 425/458

[58] Field of Search ..... 425/87, 318, 458; 15/235.7; 249/219.1

[56] References Cited

U.S. PATENT DOCUMENTS

| | | | |
|---|---|---|---|
| 2,824,443 | 2/1958 | Ames | 72/130 |
| 3,056,159 | 10/1962 | Hoveland | 15/235.7 |
| 3,932,101 | 1/1976 | Johnson et al. | 15/235.7 |
| 4,032,283 | 6/1977 | Johnson et al. | 15/235.7 |
| 4,116,604 | 9/1978 | Johnson et al. | 15/235.7 |
| 4,451,223 | 5/1984 | Mower et al. | 425/458 |
| 4,669,970 | 6/1987 | Perry | 15/235.7 |
| 4,757,572 | 7/1988 | Yon | 15/235.7 |
| 4,767,297 | 8/1988 | Mower et al. | 425/87 |
| 5,010,618 | 4/1991 | Croft | 15/235.7 |
| 5,263,836 | 11/1993 | Tinawong | 15/235.7 |

FOREIGN PATENT DOCUMENTS

| | | | |
|---|---|---|---|
| 232465 | 9/1990 | Japan | 249/219.1 |

*Primary Examiner*—Jay H. Woo
*Assistant Examiner*—John Robert Abel
*Attorney, Agent, or Firm*—Robert W. Jenny

[57] ABSTRACT

The sheet metal clip which serves to hold the adjoining ends of the top (horizontal) scraper blades of an angle head in suitable relative positions is replaced by a clip assembly in which the sides of the clip are joined to a filler block to structurally stabilize the clip. The clip assembly is held in place by a threaded fastener.

1 Claim, 2 Drawing Sheets

FIG. 1
PRIOR ART
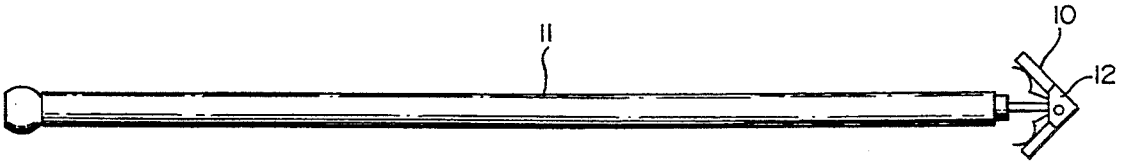
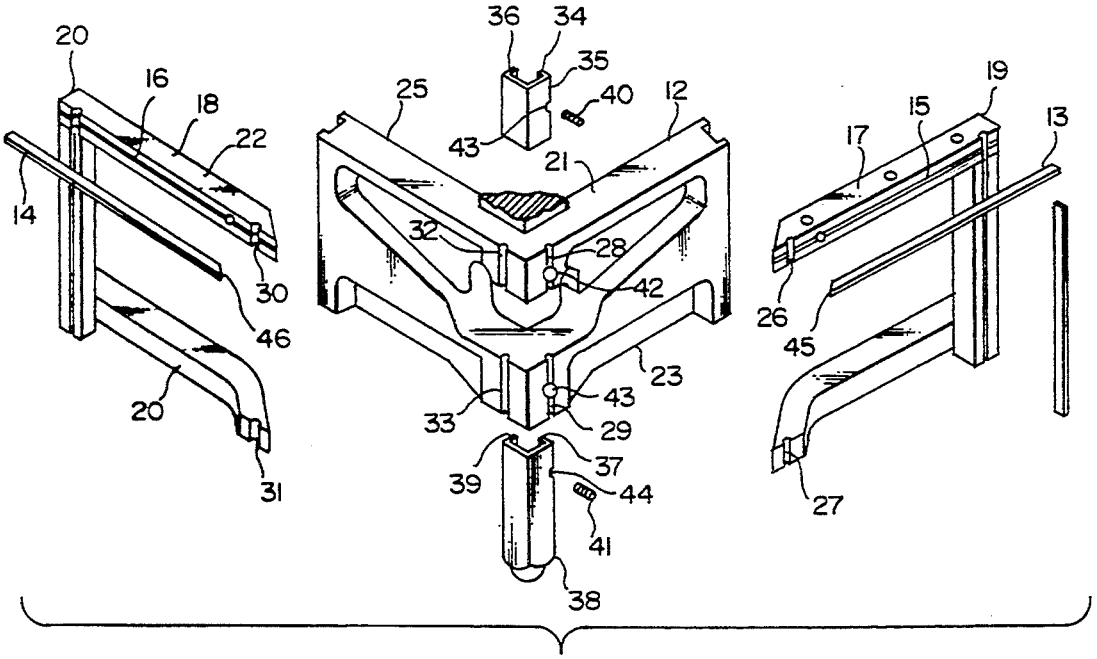
FIG. 2
PRIOR ART
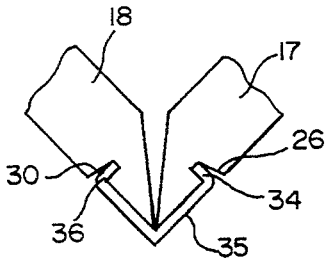
FIG. 3
PRIOR ART
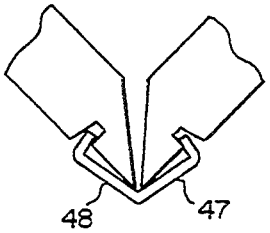
FIG. 4
PRIOR ART FIG. 5
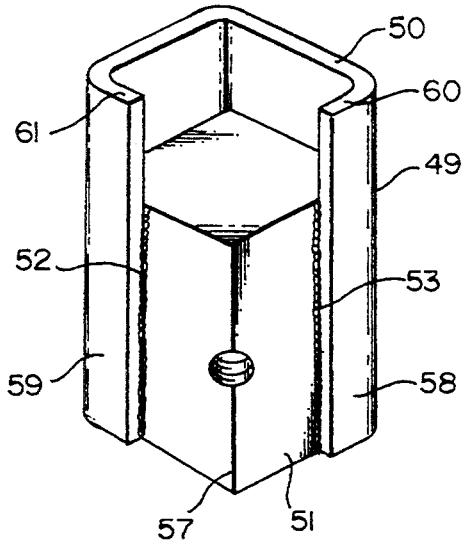
FIG. 6
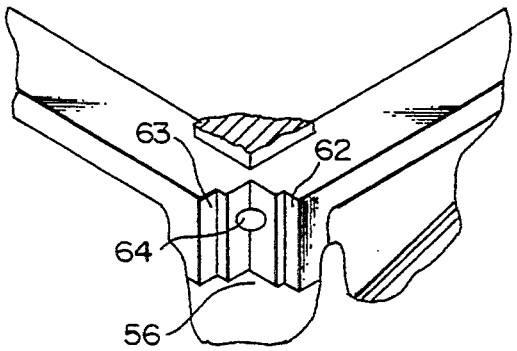
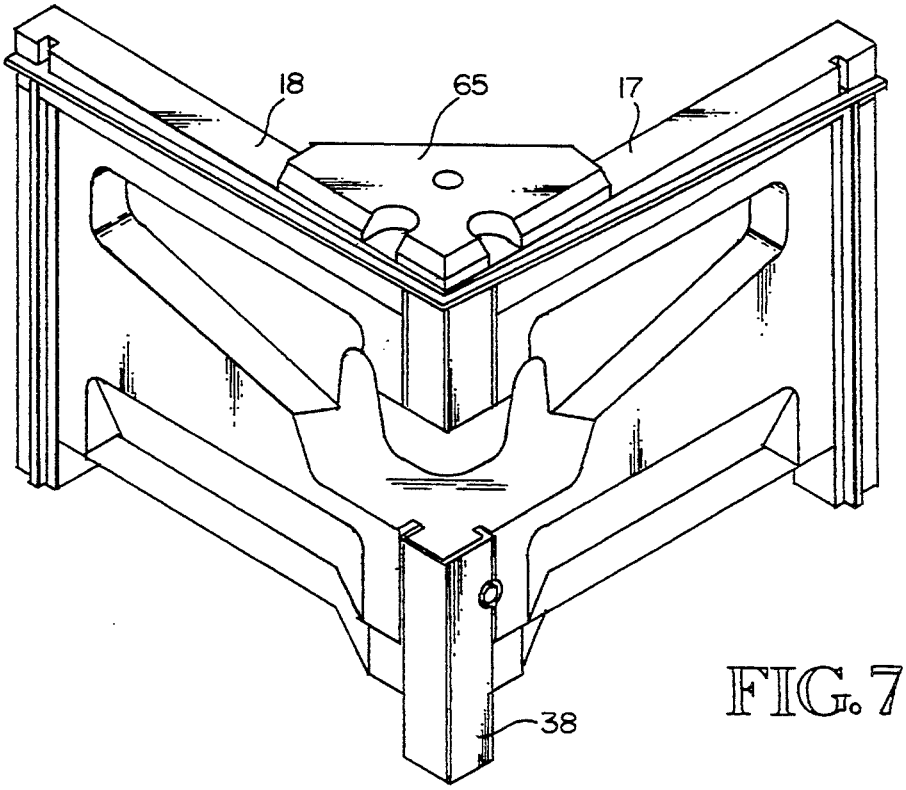
FIG. 7

ANGLE HEAD

BACKGROUND OF THE INVENTION

1. Field

This invention relates to the field of tools and apparatuses used in the field of drywall construction in which panels of plasterboard are attached to wall and ceiling structures and the joints between panels are filled with compound termed mud and the compound is smoothed in preparation for sanding and finishing. The subject invention is in the particular field of tools used to spread and smooth mud on the joints between panels at an angle to each other such as at the corners of rooms and the joints between wall and ceiling panels. The tool used at such joints is known as an angle head and the specific field of the subject invention is details of the construction of an angle head.

2. Prior Art

The direct prior art to the subject invention is the type of angle head manufactured by Concorde Tool Corp. in Surrey, B.C. Canada and by Ames Taping Tool Systems, Inc. in the United States. These tools comprise two opposite hand frame assemblies, essentially rectangular, held at approximately 90° to each other with one edge of one assembly touching and in accurate alignment with the similar edge of the other assembly. The assemblies are pivotally attached to a fixture such that the angle between the assemblies can change to match the angle between adjoining panels. The fixture is attached to a handle. Scraper blades are mounted in grooves near two edges of each assembly, the edges being those opposite the adjoining edges of the assemblies for the side blades, and an edge on each assembly for the top blades running from the adjoining edge on each assembly to the opposite edge, at the edges farthest from the handle of the tool in normal use condition. These two blades are termed the top blades and the accuracy of the contact of their ends at the adjoining ends of the assemblies is crucial to achieving satisfactory results with the angle head. Even a slight gap between the blade ends leaves an unacceptable ridge in the surface of the mud being smoothed by the head. The two assemblies and therefore the blades in the assemblies are held in the desired relative positions by two sheet metal clips, the top clip near the contacting ends of the top blades and the bottom clip at the lower edge of the assemblies. The function of the upper clip is most crucial. The clips are fitted into slits in the fixture to which they are attached and are made of material considerably harder than the material from which the fixture is cast. The clips engaging the grooves provide the pivotal connections of the assemblies to the fixture. Experience has shown that these clips often deform during use to the point of causing unsatisfactory performance of the head after unacceptably few hours of use. Also, the performance of the clip is unacceptably vulnerable to shock loads which can readily occur during normal use of the tool. Accordingly, the primary objective of the subject invention is to provide an angle head with more durable mechanism for holding the adjoining ends of the top scraper blades in accurate relative position and alignment.

SUMMARY OF THE INVENTION

The subject invention is a more durable mechanism for holding the top scraper blades in an angle head in accurate positions relative to each other. In conventional angle heads the top scraper blades are held in accurate relative positions primarily by a sheet metal clip which is held in place in slits and surrounds a portion of the fixture between the slits. In the subject invention that portion of the fixture is removed and replaced by an equivalent part which is fastened to the fixture by a threaded fastener. The clip is welded to the equivalent part with the result that when the part is attached to the fixture the clip is positioned as it is in the prior art installation but the flanges on the clip which engage the slits are welded in place, making the apparatus much more durable in terms of holding the top scraper blades in the desired positions relative to each other.

The invention is described in more detail below with reference to the attached drawings.

BRIEF DESCRIPTION OF THE DRAWINGS

FIG. 1 illustrates an angle head attached to a handle, showing the general arrangement.

FIG. 2 is an exploded view of some of the parts of an angle head showing the basic fixture, the assemblies which hold the scraper blades, the scraper blades and the clips which hold and align the assemblies and scraper blades.

FIG. 3 illustrates schematically the engagement of the prior art top clip with the elements it holds in place.

FIG. 4 illustrates the prior art clip as deformed in use.

FIG. 5 illustrates the clip assembly according to the subject invention.

FIG. 6 illustrates the modifications of the fixture to accommodate the clip assembly.

FIG. 7 illustrates the assembly of the fixture, scraper blade holding the assemblies, the scraper blades, the lower clip, and the clip assembly.

DETAILED DESCRIPTION OF THE INVENTION

The subject invention is a more durable mechanism for holding the top scraper blades in an angle head in accurate positions relative to each other. FIG. 1 illustrates an angle head 10 attached to a handle assembly 11. For purposes of this disclosure surface 12 is the top of the head and the scraper blades located near the top are the top scraper blades.

FIG. 2 is an exploded view of some of the parts of an angle head showing the prior art mechanism for holding and positioning the scraper blades. Top scraper blades 13 and 14 fit in slots 15 and 16 in members 17 and 18 of assemblies 19 and 20. These assemblies fit over surfaces 21 and 22 and 23 and 24 on fixture 25 with grooves 26 and 27 on assembly 19 aligned with grooves 28 and 29 on the fixture and grooves 30 and 31 on assembly 20 aligned with grooves 32 and 33 on the fixture. Flange 34 on clip 35 engages grooves 26 and 28. Flange 36 engages grooves 30 and 32. Also, flange 37 on clip 38 engages grooves 27 and 29 and flange 39 engages grooves 33 and 31. The clips are held onto the fixture and the assemblies are pivotally attached to the fixture by the engagements of the flanges in the grooves as described. Endwise movement of the clips is prevented by set screws 40 and 41, threaded into holes 42 and 43 in the fixture and engaging slots 43 and 44 in the respective clips. Ends 45 and 46 of blades 13 and 14 respectively are held in contact and accurate alignment by the top clip 35 because of the engagement of the clip with members 17 and 18. This engagement is shown schematically in FIG. 3 with parts numbered as in FIG. 2. FIG.

4 illustrates, with some exaggeration, permanent deformation of the clip which occurs in use. Sides 47 and 48 of the clip are no longer at a right angle to each other but, instead, flare out at an angle greater than 90°. This deformation allows an unacceptable gap between the adjacent ends 45 and 46.

To prevent this deformation, the primary objectives of the subject invention, in the subject invention clip 35 is replaced by a clip assembly 49 as shown in FIG. 5. The assembly comprises clip 50 and filler block 51. These two parts are welded together along edges 52 and 53. The assembly is held in place on the fixture by engagement of a threaded fastener in threaded hole 54.

FIG. 6 illustrates the modification of the fixture to accommodate the clip assembly. Corner 55 in FIG. 2 is removed. Notch 56 accepts corner 57 of the clip assembly and faces 58 and 59 of flanges 60 and 61 register against faces 62 and 63 of the remaining portions of grooves 28 and 32 (FIG. 2). The attachment of the clip to the filler block prevents the undesired deformation as shown in FIG. 4. Hole 64 in the fixture accommodates the fastener which holds the clip assembly in place.

FIG. 7 illustrates the assembly of the fixture, the scraper blade holding assemblies, i.e. frames, the top scraper blades, the subject clip assembly and bottom clip 38. Portion 65, termed a nose cone, is part of the fixture not shown in FIGS. 2 and 6. It helps retain members 17 and 18 against the uploads on those members and protects the ends of the scraper blades.

It is considered to be understandable from this description that the subject invention meets its objective. It provides a more durable mechanism for holding the adjoining ends of the top (essentially horizontal) scraper blades of an angle head in accurate relative position and alignment.

It is also considered to be understood that while one embodiment of the invention is shown herein, other embodiments and modifications of the one disclosed are possible within the scope of the invention which is limited only by the attached claims.

I claim:

1. In an angle head having first and second top scraper blades, first and second assemblies in which said first and second scraper blades are held, and a fixture to which said first and second assemblies are connected by first and second pivotal connections, said first and second pivotal connections comprising at least one groove in each assembly and a clip assembly attached to said fixture and engaging both of said at least one grooves, said clip assembly comprising a filler block and a clip having first and second sides, said sides being attached to said filler block to structurally stabilize said clip.

* * * * *